US005310102A

United States Patent [19]

Hougham

[11] Patent Number: 5,310,102

[45] Date of Patent: May 10, 1994

[54] APPARATUS FOR FIELD SLEEVING OF LETTUCE AND OTHER VEGETABLES

[76] Inventor: John K. Hougham, P.O. Box 223381, Carmel, Calif. 93923

[21] Appl. No.: 890,805

[22] Filed: Jun. 1, 1992

[51] Int. Cl.[5] ..... A45F 5/00

[52] U.S. Cl. ..... 224/267; 224/151; 224/222; 224/268; 248/100

[58] Field of Search ..... 224/151, 191, 222, 253, 224/267, 268; 222/175, 608; 221/185, 26, 27, 312 A; 248/100, 99, 95, 309.2; 383/37; 206/554; 220/404, 17.1; 56/327.1, 329

[56] References Cited

U.S. PATENT DOCUMENTS

| | | | |
|---|---|---|---|
| 868,692 | 10/1907 | Otis | 220/17.1 |
| 3,646,723 | 3/1972 | Meroney | 206/554 X |
| 4,062,170 | 12/1977 | Oren | 248/100 X |
| 4,363,405 | 12/1982 | Christie | 206/554 |
| 4,511,358 | 4/1985 | Johnson et al. | 224/191 X |
| 5,139,219 | 8/1992 | Navarro | 248/99 X |

*Primary Examiner*—Henry J. Recla
*Assistant Examiner*—Glenn T. Barrett
*Attorney, Agent, or Firm*—John S. Ferrell

[57] ABSTRACT

A vegetable sleever is disclosed suitable for field-wrapping of vegetables such as leaf lettuce at the time of harvesting in order to prevent shipping damage. The sleever contains a steel frame assembly having three hangars for holding plastic sleeves. For each wrapping, a sleeve is individually opened, the product inserted and the sleeve removed from the sleever assembly and placed in a packing container. The sleeves are protected from wind and dirt by a front shroud covering the sides and lower front, and protective flaps on top. The frame assembly may be either used with a harness and attached to the lower leg while working in the field or mounted to a fixed support on a harvester or in a vegetable preparation area.

4 Claims, 5 Drawing Sheets

APPARATUS FOR FIELD SLEEVING OF LETTUCE AND OTHER VEGETABLES

BACKGROUND OF THE INVENTION

1. Field of the Invention

This invention pertains generally to the field of agriculture, and more particularly to vegetable and produce harvesting and the field-sleeving of produce in protective plastic sleeves prior to packing.

2. Description of the Background Art

Traditional harvesting techniques for lettuce and other leafy vegetables have relied on cutting and packing the lettuce heads into large boxes in the field. The problem with packing several dozen heads of lettuce into a single box, is that substantial product damage is incurred as the heads contact each other and as the compressed lettuce heads are unpacked at the produce retailer. Large numbers of lettuce leaves are torn away, reducing the overall weight, size and quality of the individual heads. A solution towards reducing product damage has been to sleeve or wrap the individual heads into plastic sleeves as the heads are harvested and before they are packed. This packaging into plastic sleeves has the added benefit of containing leaf moisture and of keeping the product clean during subsequent handling.

The harvesting and packing of lettuce is largely performed by hand. Harvesters cut the lettuce and then hand place the lettuce in rows to be boxed. What is needed is an inexpensive and simple-to-operate sleeving apparatus that can be used by the harvester prior to boxing to allow efficient sleeving of leaf lettuce heads as part of the normal harvesting routine.

SUMMARY OF THE PRESENT INVENTION

The present invention is a sleeve assembly for individually wrapping or sleeving vegetables. The preferred embodiment consists of a steel frame, having a "U" shape, to which are attached three sleeve hangers. The sleeves consist of bottomless plastic bags, sized to accommodate the vegetable item being wrapped. The hangers store approximately 200 sleeves or more, and each sleeve is individually pulled forward on the hanger, opened to allow insertion of the vegetable item, filled with the product, and then pulled free of the frame for packing.

In order to protect the sleeves from being blown about by the wind, the frame and sleeve assembly is partially covered on the top, sides and front and back by a plastic shroud. Three top flap protectors are arranged to permit easy insertion of the product into the sleeves and to protect the vegetable product from damage by the sleeve hangers. The front shroud forms side walls running the length of the sleeve, joining at the lower front part of the sleeve, and provides an opening to approximately the top two-thirds of the sleeve to enable easy sleeve removal following vegetable insertion.

Formed into the lower back of the frame is a flange which is sized to approximate the size and shape of the sleeves. The flange inserts into a similarly sized pocket, which is part of a harness assembly worn by harvesters during use. The harness straps to the calf or lower leg portion of the user with a leg strap, and a waist belt strap suspends from the user's belt, the combination providing both vertical and horizontal support for the sleeve assembly. The user may then sleeve the vegetable in a single stooping motion: picking the vegetable from the ground or washing basin, inserting the vegetable into the sleever, and transferring the filled sleeve from the sleever into a packing carton.

Attached to the rear of the frame is a frame groove to which may be inserted the tongue of a frame support. The frame support is a brace which conveniently mates with the frame assembly and permits mounting of the frame assembly to a fixed object such as a harvester, the bed of a pick-up truck, or a vegetable preparation area.

In summary, the frame assembly may be used in conjunction with the harness assembly as a portable sleeving apparatus, which is worn by the harvester. The frame assembly may also be used in combination with the frame support and mounted in a fixed position.

BRIEF DESCRIPTION OF THE DRAWINGS

FIG. 3(*b*) is a view of side shroud (37) attached to front shroud (33) using fabric (44);

DETAILED DESCRIPTION OF THE PREFERRED EMBODIMENT

Figure 1:
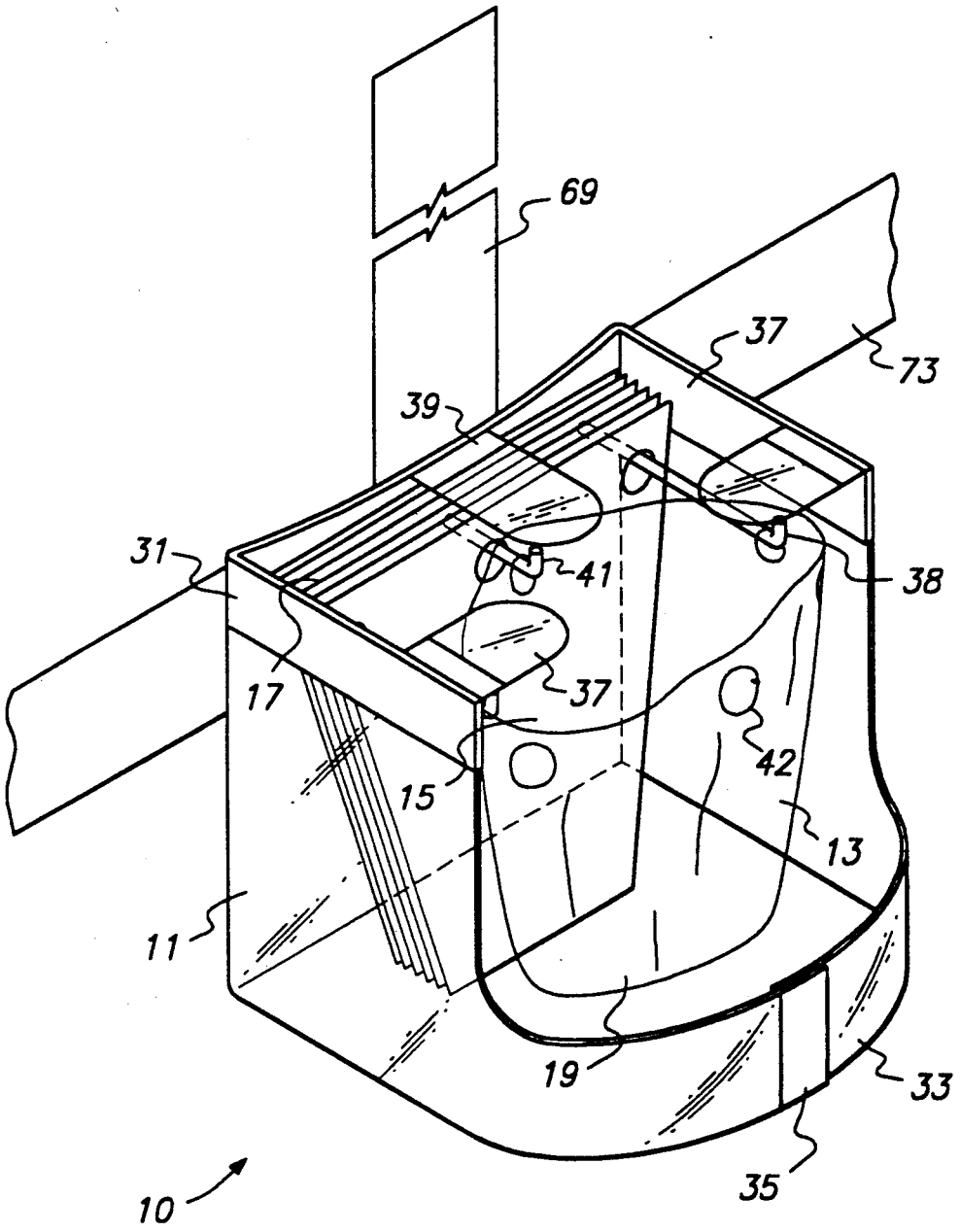
FIG. 1 is a front perspective view of sleever assembly (10) of the present invention.

Referring now to FIG. 1, sleever assembly 10 of the present invention is shown. Sleever assembly 10 may be worn attached to the front of either lower leg by wrapping and securing leg strap 73 around the calf, and attaching and suspending belt strap 69 from the waist. Sleever assembly 10 is used in the harvesting of vegetables and other produce, where each product is individually sleeved or wrapped prior to shipping. Individual sleeving is particularly useful in the shipping of lettuce, where the leaves can easily be damaged in packing. Individual sleeving also tends to allow the lettuce product to retain water thereby prolonging shipping life.

The structural support for sleever assembly 10 is provided by frame 31. Frame 31 is constructed of sheet steel, and bent to form a three-sided "U". Three hangars 38,41 project from the frame to support a reservoir of 200 or more sleeves 17. The hangars 38,41 project through holes 42 in the top of the sleeves, and the holes 42 permit an individual sleeve 13 to be selected and removed from the hangar by pulling sleeve 13 away from the frame. Prior to completely removing sleeve 13 from hangars 38,41 the sleeve may be opened at the top to expose a mouth 15, into which the lettuce or other vegetable product may be inserted. The product is pushed to the sleeve bottom 19, and the sleeve 13 is then removed from hangars 38,41. Following removal of sleeve 13 from hangars 38,41, a new sleeve is selected and opened.

A feature of the present invention is the protection which frame assembly 11 provides to the product and sleeves 17 from wind and dirt. Attached to the sides of frame 31 is a plastic front shroud 33 which descends from the frame approximately the length of sleeve 13 and provide a protective enclosure sufficiently large to hold sleeve 13 containing inserted product. The front shroud 33 joins near the sleeve bottom 19 at shroud seal 35, and can be opened to allow easy insertion of sleeves 17. Front shroud is preferably made of flexible ⅛th plastic sheeting, although a variety of other materials could be equivalently used. Shroud seal 35 is formed using VELCRO-type eye-and-hook connecting strips. A large section of the front of frame assembly 11 from above shroud seal 35 to sleeve mouth 15 remains open to permit easy removal of the product following sleeving.

The top of frame assembly 11 is protected by two side protectors 37 and back protector 39. These plastic protectors 37,39 are shaped as half-ovals and act as guards against product damage from sleeve hangars 38,41 as the product is inserted into sleeve 13. The product is pushed through the protectors 37,39 and into sleeve 13. Resiliency of protectors 37,39 cause them to spring back to their original positions once the product has been sleeved.

Figure 2:
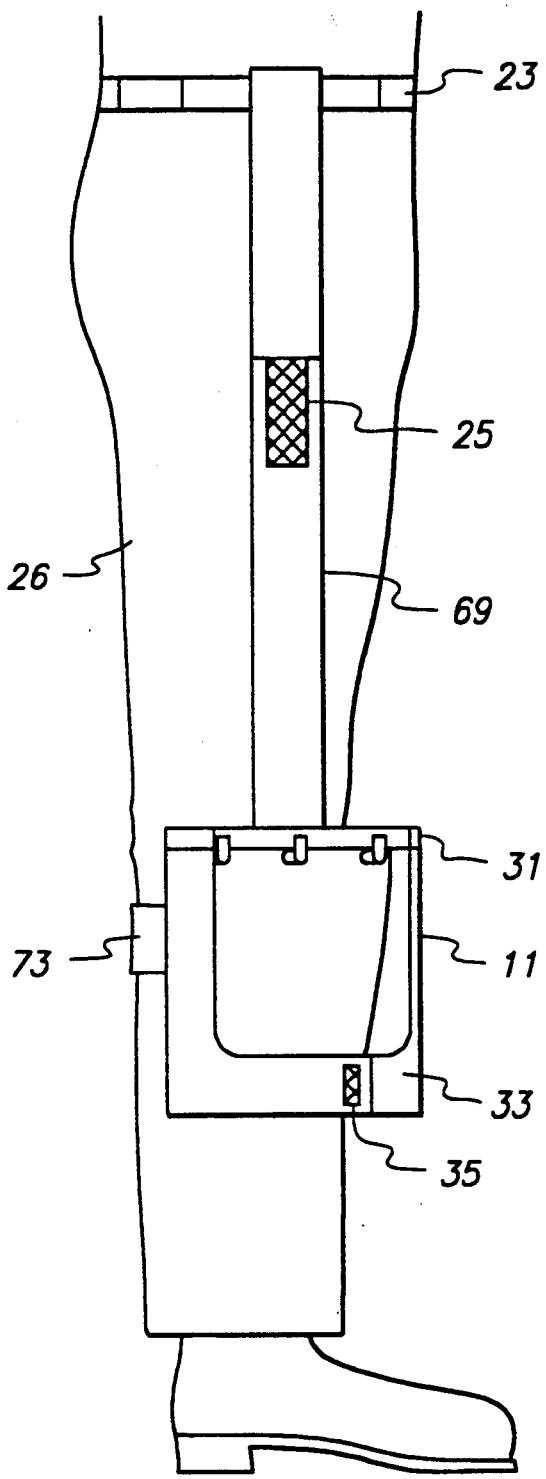
FIG. 2 is a front perspective view of sleever assembly (10) of FIG. 1, shown attached to the lower leg of the user by leg strap (73) and belt strap (69)

Referring now to FIG. 2, a diagram is shown of the sleever assembly 10 positioned as normally worn. The assembly is shown worn on lower right leg 26, although in application the unit can be worn on either side. Leg strap 73 fixes sleever assembly 10 to the lower leg, and belt strap 69 supports assembly 10 in the vertical direction. Belt strap 69 loops around belt 23 of the user and is fixed by connector 25, which is constructed of VELCRO-type connector material. The user stoops over to pick up the product and in the same stooping motion inserts the product into sleeve 13 (FIG. 1) connected to the frame as described above. Sleeve 13 is then removed from frame 31 and the user proceeds with a subsequent product.

Figure 3A:
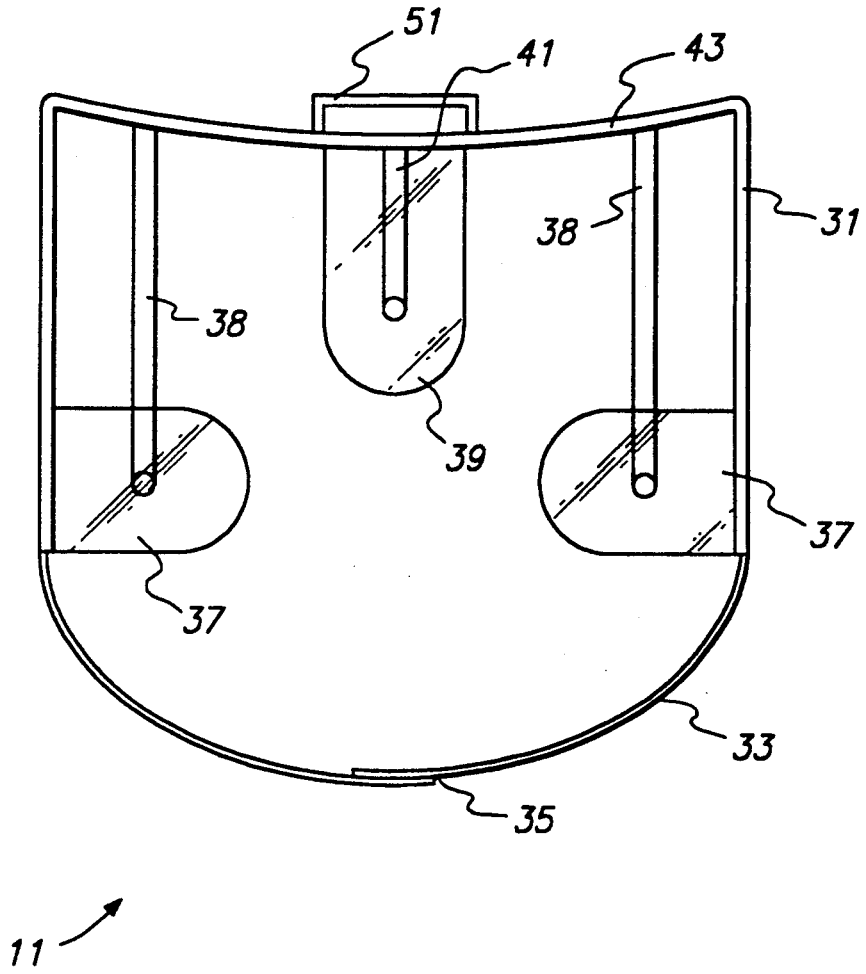
FIG. 3(*a*) is a top view of frame assembly (11)
Figure 3B:
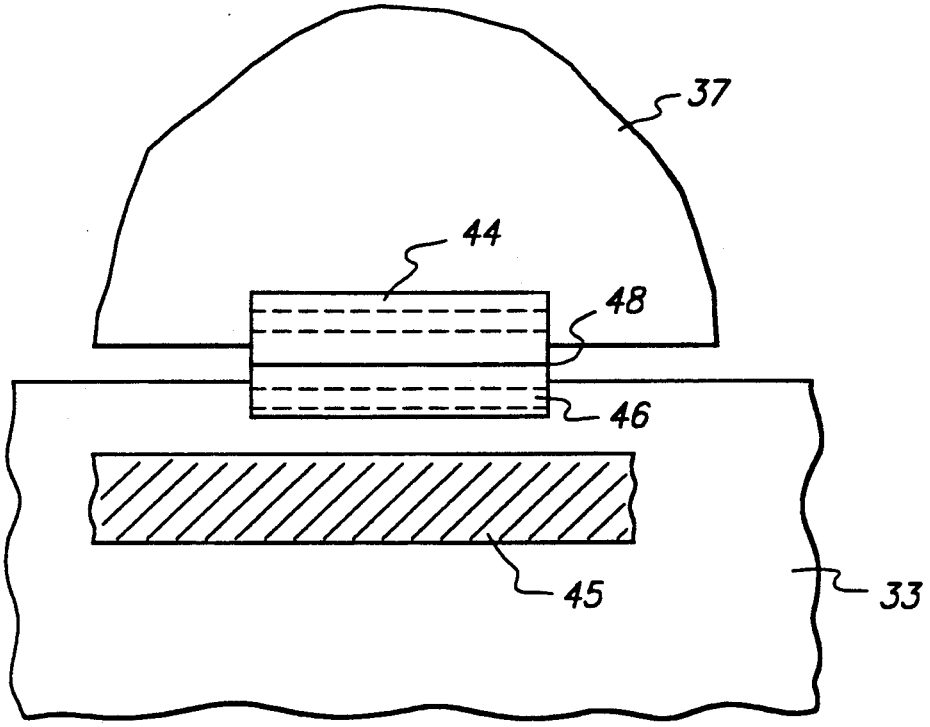

Referring now to FIG. 3(*a*), a top view of frame assembly 11 is shown. Frame assembly 11 consists of the components of sleeve assembly 10, without the various straps 69,73 which attach frame 31 to the user. The preferred embodiment of frame 31 is shown in which the rear frame 43 of frame 31 is slightly curved to conform to the contours of leg 26. Although useful, this contour feature is not critical. Hangars 38, 41 are shown projecting from rear frame 43. The hangars are constructed of steel and are welded to rear frame 43. Side hangars 38 project from rear frame 43 and then bend in and up slightly to facilitate the movement and functionality of sleeve 13 as the sleeve is pulled off of hangars 38,41 and filled with product. Mid-hangar 41 projects from rear frame 43 and then bends slightly upward to prevent sleeve 13 from slipping along hangars 38, 41 as the sleeve 13 is pulled forward and being filled with product. It should be noted that although the preferred embodiment utilizes three hangars 38,41, embodiments with fewer or greater numbers of hangars would be obvious to one of ordinary skill in the art.

Frame groove 51 is shown connected to rear frame 43 and is discussed in more detail below.

Front shroud 33 is shown arching around to the front of frame assembly 11, providing a protected space beneath and in front of hangars 38,41 for the product to be loaded into sleeves. Shroud seal 35 holds shroud 33 together and maintains its arched shape.

Referring now to FIG. 3(*b*), the attachment of side protector 37 to front shroud 33 is shown. Since side and back protectors 37 and 39 partially cover mouth 15 of sleeve 13, each time a product is inserted into sleeve 13, these protectors will be pushed and flexed. It is therefore important that the connection between the protectors 37,39 and front shroud 33 be strong yet resilient. The preferred method of connection is to sew a strip of canvas or heavy fabric 44 to front shroud 33 using stitches 46, and to similarly attach the strip of fabric 44 to protector 37, forming a hinge. The function of hinge 44 is to provide orthogonality between protector 37 and shroud 33 and to absorb stress and impact between these components. Connector 45 extends the width of front shroud 33 and is used to attach front shroud 33 to frame 31. The preferred embodiment utilizes VELCRO-type connectors between front shroud 33 and frame 31; however, alternative equivalent connectors will also work. FIG. 3(*b*) shows the connection between side protector 37 and front shroud 33, however, a similar connection is made between back protector 39 and flange 47 (FIG. 4).

Figure 4:
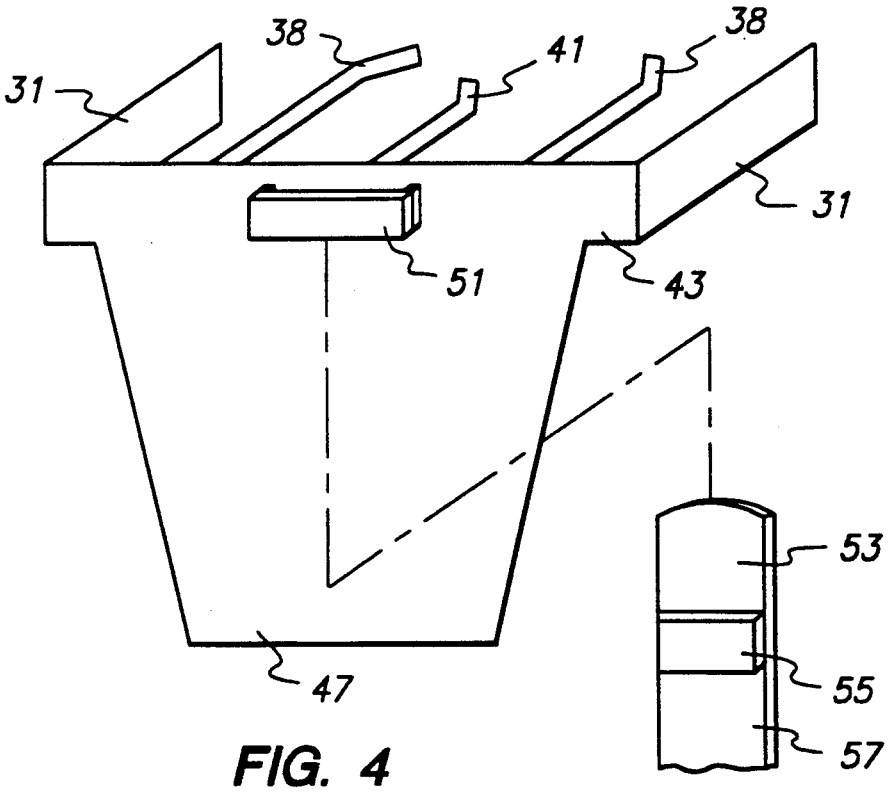
FIG. 4 is a rear perspective view of frame (31) showing frame groove (51) and frame support (57)

Referring now to FIG. 4, a rear view of frame 31 is shown. Formed as part of rear frame 43 is flange 47, which is used to fix frame assembly 11 to harness 60 (shown in FIG. 5, and described below) in order to provide stability to the sleever. Flange 47 is trapezoidal in shape with its widest dimensions approximating those of sleeves 17.

Also attached to the approximate center of rear frame 43 is frame groove 51. Frame groove 51 is a steel slot that extends from the rear frame 43 and is sized to allow the insertion of tongue 53 of frame support 57. Frame groove 51 and support 57 add a flexible dimension to the functionality of frame assembly 11 by facilitating the utility of frame assembly 11 as a stand-alone sleeving unit. Frame support 57 can be mounted in a fixed position such as on a harvester, a vegetable preparation area, or a pick-up truck, and frame assembly 11 can be utilized independent of harness 60. Frame support 57 is placed in a fixed position and tongue 53 is inserted up into frame groove 51 such that frame support 57 contacts and is parallel to flange 47. Frame groove 51 rests atop stop 55. The fit between frame groove 51 and tongue 53 should be sufficiently snug to prevent wobbling of the frame assembly 11 during use.

Figure 5:
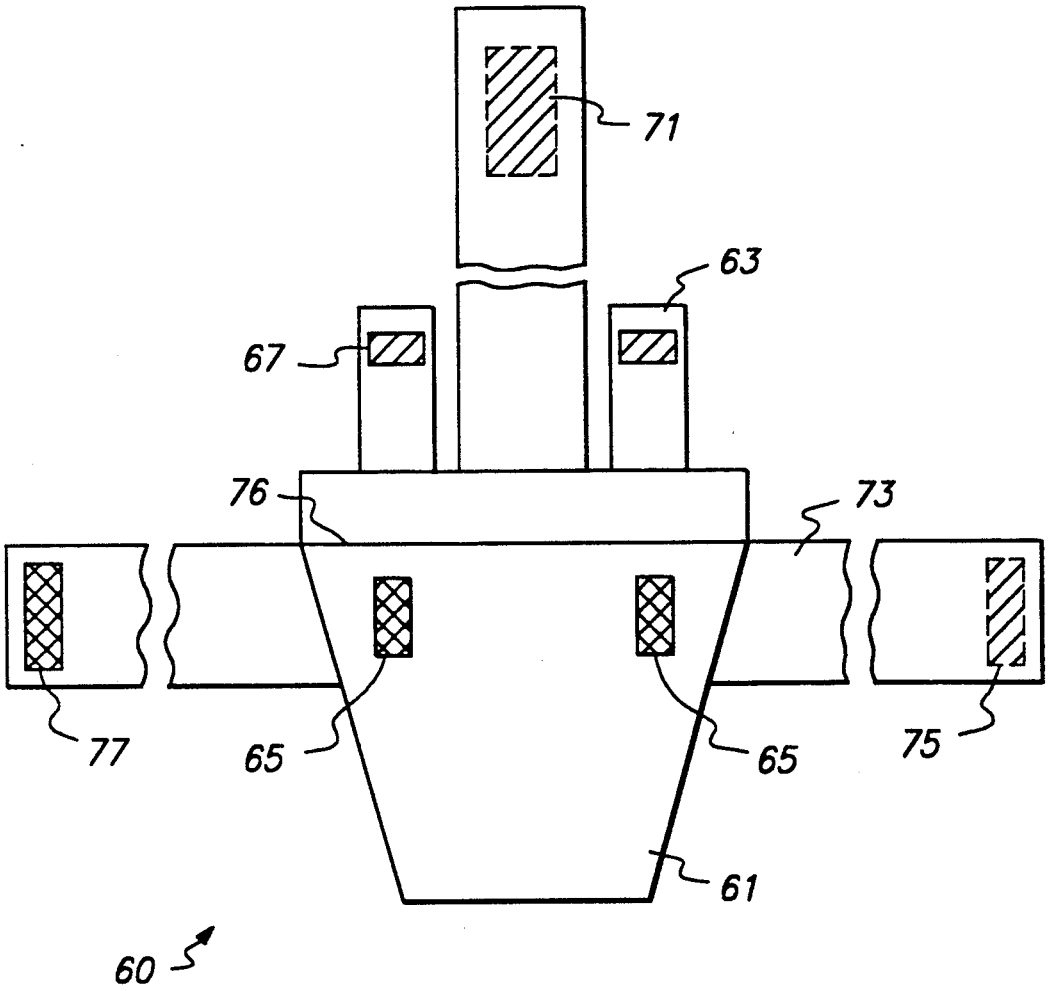
FIG. 5 is a rear view of harness (60).

Referring now to FIG. 5, harness 60 is shown for supporting and carrying frame assembly 11 in the field. Harness 60 is constructed around pocket 61, which is sized to hold flange 47. Once flange 47 is inserted into opening 76 flaps 63 are drawn over the top of rear frame 43 and snaps 67 are connected to catches 65. The snaps and catches 67,65 are constructed of VELCRO-type material in the preferred embodiment. Leg strap 73 is shown having snap 75 and catch 77. Leg strap 73 also uses a VELCRO-type fastener in the preferred embodiment. Belt strap 71 is positioned perpendicularly to the leg strap 73 and is worn attached to belt 23 (FIG. 2). A VELCRO-type connector 25 is used to hold belt strap 71 in place. Harness 60 is preferably constructed of canvas, although leather, fabric and various synthetic materials will work equivalently well.

I claim:

1. An apparatus for field sleeving produce into plastic sleeves comprising:

a "U"-shaped frame having a rear surface, two side surfaces, and a front opening;

hangar means connected to and projecting from the rear surface of the frame towards the front opening for holding and dispensing the plastic sleeves through the front opening;

front shroud means attached to the two side surfaces of the frame and descending downwardly from the frame approximately the distance of the plastic sleeves, and joining below the front opening of the frame for substantially enclosing and protecting the sleeves; and protector means attached to the frame and covering the hangar means to prevent damage to the produce from contact with the hangar means during sleeving.

2. The apparatus as in claim 1 wherein the protector means are half-oval plastic flaps.

3. The apparatus as in claim 1 further comprising:

a flange descending from the rear frame surface; and harness means for wearing the apparatus attached to a leg further comprising a pocket into which the flange is inserted for holding the flange secure, a leg strap connected to the pocket for attaining the harness means to the leg, and a belt strap connected to the pocket and orthogonally oriented with respect to the leg strap for suspending the frame from a conventional waist belt.

4. The apparatus as in claim 1 wherein the frame further comprises a frame groove adapted to receive a tongue of a fixed support in order that the apparatus may be used as a fixed-position vegetable sleever.

* * * * *